US011085232B2

(12) United States Patent
Mort

(10) Patent No.: US 11,085,232 B2
(45) Date of Patent: Aug. 10, 2021

(54) EXIT SIGN SHADE FOR CLASSROOM VIEWING WINDOW

(71) Applicant: Melinda Mort, Fallon, NV (US)

(72) Inventor: Melinda Mort, Fallon, NV (US)

(73) Assignee: Beowawe, LLC, Jackson, WY (US)

( * ) Notice: Subject to any disclaimer, the term of this patent is extended or adjusted under 35 U.S.C. 154(b) by 0 days.

(21) Appl. No.: 16/374,241

(22) Filed: Apr. 3, 2019

(65) Prior Publication Data

US 2021/0062570 A1 Mar. 4, 2021

Related U.S. Application Data

(60) Provisional application No. 62/652,333, filed on Apr. 4, 2018.

(51) Int. Cl.

| | |
|---|---|
| ***E06B 3/26*** | (2006.01) |
| ***E06B 5/10*** | (2006.01) |
| ***E06B 9/04*** | (2006.01) |
| ***E06B 7/28*** | (2006.01) |

(52) U.S. Cl.

CPC ..... *E06B 5/103* (2013.01); *E06B 7/28* (2013.01); *E06B 9/04* (2013.01); *E06B 5/106* (2013.01)

(58) Field of Classification Search

CPC .... E06B 5/00; E06B 9/17023; E06B 9/17053; E06B 9/01; E06B 9/264; E06B 9/384; E06B 9/323; E06B 2009/2622; E06B 2009/2429; E06B 2009/2441; E06B 2009/2646; E06B 2009/2435; E06B 2009/2458; E06B 2009/002; G09F 3/18; G09F 3/20; Y10T 24/27; Y10T 24/32

USPC ..... 52/202, 203; 160/84.08, 107, 10, 368.1; 40/584, 600, 593, 70

See application file for complete search history.

(56) References Cited

U.S. PATENT DOCUMENTS

| | | | | |
|---|---|---|---|---|
| 4,109,760 | A * | 8/1978 | Marra | A62B 1/20 182/48 |
| 5,205,334 | A * | 4/1993 | Judkins | E06B 9/174 160/89 |
| 6,712,115 | B2 * | 3/2004 | Judkins | E06B 9/264 160/178.1 R |
| 7,475,487 | B1 * | 1/2009 | Johnson | A61B 5/1072 33/493 |
| 7,849,616 | B2 * | 12/2010 | Bolton | G09F 3/20 40/600 |
| 8,991,468 | B2 * | 3/2015 | Bolton, III | E06B 9/262 160/168.1 R |
| 9,536,448 | B1 * | 1/2017 | Kordecki, Jr. | A61B 5/107 |
| 10,589,685 | B1 * | 3/2020 | Talavera | A45D 42/02 |

(Continued)

*Primary Examiner* — Chi Q Nguyen

(74) *Attorney, Agent, or Firm* — Mark A. Goodman, Esq.

(57) ABSTRACT

A shade adapted for covering a classroom viewing window and assisting with compliance with emergency protocol during an emergency is disclosed. The shade may include a plurality folds connected to each other by a plurality of hinges configured to cover a classroom viewing window. Emergency related information and status indicators may be revealed upon the unfolding of the shade to assist teachers, school officials, police, and others to comply with established school emergency protocol. The shade further fulfills the requirement that the classroom viewing window be covered during an emergency lockdown. The shade may function as a standard "Exit" sign during non-emergency time.

11 Claims, 6 Drawing Sheets

(56) References Cited

U.S. PATENT DOCUMENTS

| | | | | |
|---|---|---|---|---|
| 2006/0086469 | A1* | 4/2006 | Nien | E06B 9/40 160/243 |
| 2007/0039699 | A1* | 2/2007 | Colson | E06B 9/264 160/121.1 |
| 2009/0000169 | A1* | 1/2009 | Houssain | G09F 15/0068 40/605 |
| 2009/0183447 | A1* | 7/2009 | Hay, III | E06B 9/02 52/202 |
| 2011/0155199 | A1* | 6/2011 | Harper | E04H 15/32 135/143 |

* cited by examiner

EXIT SIGN SHADE FOR CLASSROOM VIEWING WINDOW

BACKGROUND OF THE DISCLOSURE

Technical Field of the Disclosure

The present disclosure relates generally to secure exit sign shades and more particularly to an advanced design of a secure exit sign shade for covering a classroom viewing window during a school lockdown.

Description of the Related Art

A secure exit shade is a means to provide safety for doors in school, college, office and other organizations in lockdown emergencies. It is very fast and easy to install for the use. It is a simple solution for school safety needs. The secure exit shades help secure the safety of the students inside the classrooms. These shades prevent the attacker or threat from seeing what goes inside the rooms since they block the visibility of potential targets.

The secure exit shade solves several problems associated during lockdown procedures and is far superior to any previous art or products on the market. During an event of lockdown, teachers or other personnel immediately checks the classroom door and look in the hallways to bring in any students who might be outside. They lock the door, cover the viewing window, take roll, email designated personnel, and place any color coded cards under the door to indicate the status of the room. Every school in the United States have started following these procedures, but there is nothing on the windows or anything that would help organize and speed up the response time during emergencies like the secure exit shade.

Several methods have been developed in the art for covering a classroom door viewing window during school lockdown shade; one such method describes a shade that normally stored on a mounting system that is positioned on a wall surface adjacent to the door window. It is fabricated from a solid, opaque material having fastener(s) on its rear surface to effect quick and easy attachment to the door window. However, this type of shades can prevent only the visual access of the classroom door window. They don't provide any emergency instructions to the class teachers or to the police men.

Another method discloses a magnetic cordless shade whose magnetic latching assembly is disposed between the header and the footer to keep the blind in a folded condition. Pulling a pull cord disposed on the footer releases the magnetic latching mechanism thereby rapidly unfolding the blind. However, this magnetic latching assembly is designed with a simple technique. They lack space in between header and footer to provide any valuable instructions or quick reference to the class teachers.

Yet another method describes a five-layer window shade fabric especially useful in forming a Roman shade which will substantially increase the insulating factor for a glass windowpane. However, this type of shade fabric material is flammable and easily falls off from the classroom door. Similarly, certain blind type products too are available, but the blinds are hard to install on these viewing windows because the frame is not very deep, so installing blinds is almost impossible. Blinds often will break, bend, and tangle. They only serve one function and often fall apart within a few years in schools.

Therefore, there is a need for a secure exit shade for lockdown emergencies at schools and when pulled down over the classroom viewing window it blocks the view of intruders, gives emergency instructions to teachers, and provides classroom status information for emergency personnel or police. Such a needed device would provide a simple solution for the school safety needs. Such a device would be useful by preventing the main visual access to the classroom door window. Such a secure exit shade would solve several problems for teachers during lockdown procedures and would provide a superior solution to any previous art or products on the market. Further, such a secure exit shade would need a high level of importance and could be used in the school, college, office as well as public or private offices and hospitals. The present embodiment overcomes shortcomings in the field by accomplishing these critical objectives.

SUMMARY OF THE DISCLOSURE

To minimize the limitations found in the existing systems and methods, and to minimize other limitations that will be apparent upon the reading of the specifications, preferred embodiment of the present invention provides a secure exit shade that covers the window of the classroom door and prevents the visual access of the classroom door window and gives emergency instructions to teachers.

The secure exit shade is made of powder coated metal that is folded into five sections and is held together using heavy duty magnets. Each section is attached to the other using a small hinge that allows the shade to be folded up or down. The sides of the shade act as feet which are bolted to the inside of classroom doors using plurality of bolts. It straddles the window which allows the shade to be moved up or down over the window frame to assure a proper fit. Each fold section represents different instructions, the first fold section displays with yellow and red color code, for instance. The second fold section has a plastic pocket, wherein specific instructions for the classroom and/or the class roster can be displayed for convenience. The third fold section has a color wheel that shows the status of the classroom by turning the color wheel and displaying a certain color. The fourth fold section describes what each of the colors means on the status or color wheel. The last fold section displays the word 'EXIT'. There is a cut out tube shaped handle for pulling down the secure exit shade. When the secure exit sign shade is not deployed or pulled down, it remains folded up at the top of the window displaying the 'Exit' section of the fold.

A first objective of the present embodiment is to provide a secure exit shade that covers a classroom door window and blocks the view of intruders.

A second objective of the present embodiment is to provide a secure exit shade designed with a plastic pocket on the second fold for mentioning a specific instruction for that classroom and class roster can be displayed for convenience.

A third objective of the present embodiment is to provide a secure exit shade for mentioning the status of the room by indicating with the help of a color wheel.

A fourth objective of the present embodiment is to provide a secure exit shade that is designed with an intelligent way such as on the back side of the secure exit sign shade providing a small cut out of a triangle which allows the color to be seen by emergency rescue teams or police.

Another objective of the present embodiment is to provide a secure exit shade that gives emergency instructions to teachers, and provides classroom status information for emergency personnel or police.

Yet another objective of the present embodiment is to provide a secure exit shade that is designed with a color code and color wheel, later it mentions how each color is indicated for different signals.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1A:
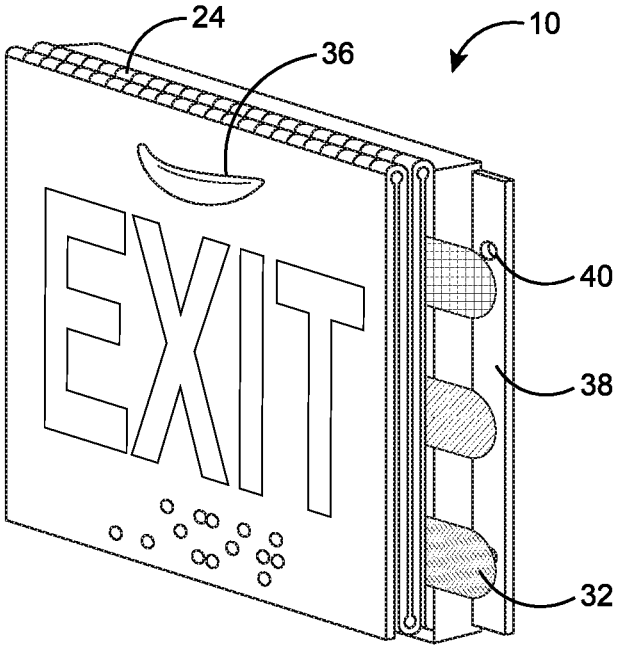
FIG. 1A illustrates a front view of secure exit sign shade in a folded and closed position in accordance with the preferred embodiment of the present invention.
Figure 1B:
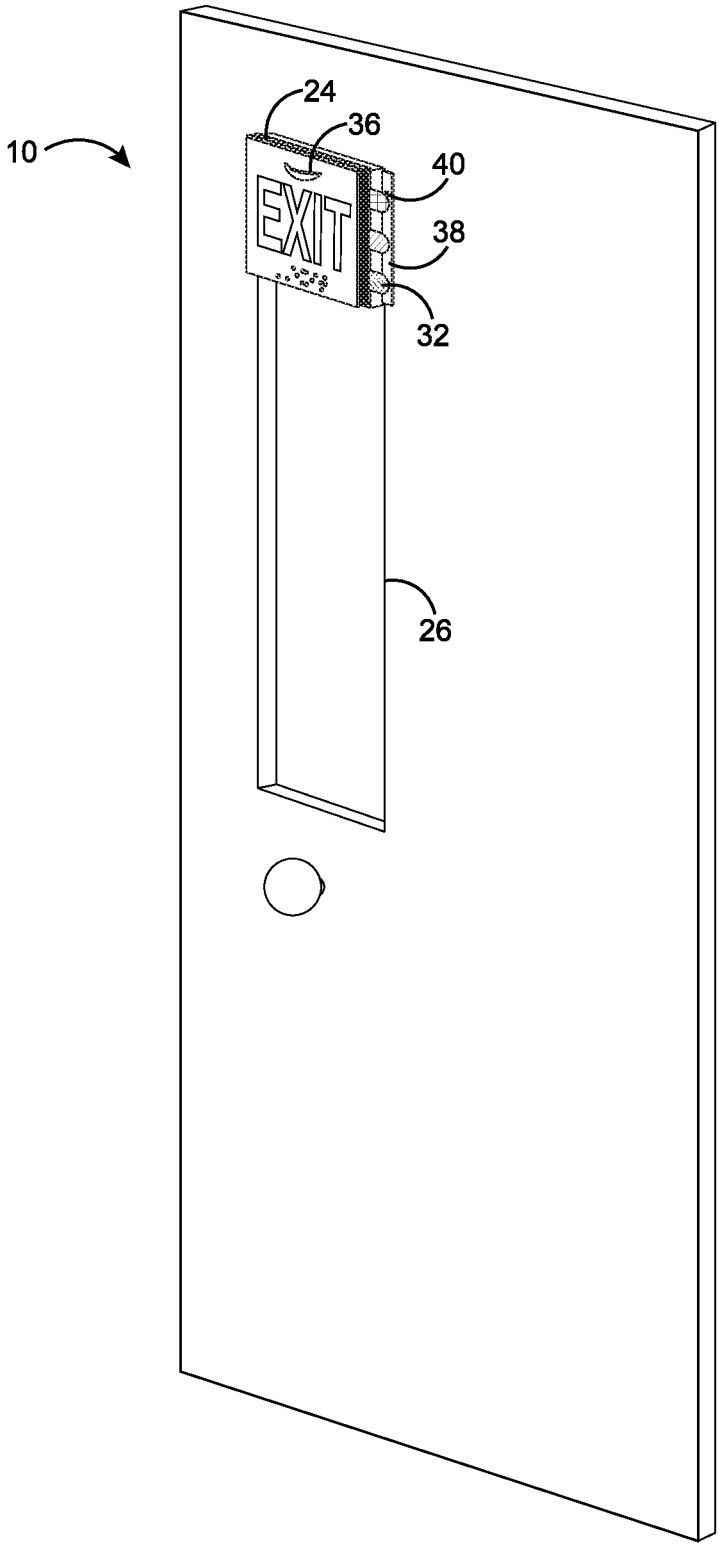
FIG. 1B illustrates a front view of the closed secure exit sign shade fixed on a classroom door in accordance with the preferred embodiment of the present invention.

FIGS. 1A and 1B illustrate a front view of a secure exit sign shade 10 in a closed and folded position; and a front view of the closed secure exit sign shade 10 fixed on a classroom door 28. The secure exit sign shade 10 is made up of powder coated metal and is folded into five different sections. Each folded section displays instructions with different colors. The sides of the shade act as feet 38 which are bolted to the inside of the classroom doors 28 using a plurality of bolts 40 as shown in FIG. 1A. The secure exit sign shade 10 straddles the class door window 26 which allows the shade to be moved up or down over the window frame 26 of the classroom door 28 to assure a proper fit. For pulling down the exit shade, a small cut out tube shaped handle 36 is provided. When the secure exit sign shade 10 is not deployed or pulled down, it remains to folded up at the top of the window 26 displaying the 'Exit' section of the fold as shown in FIG. 1B.

Figure 2A:
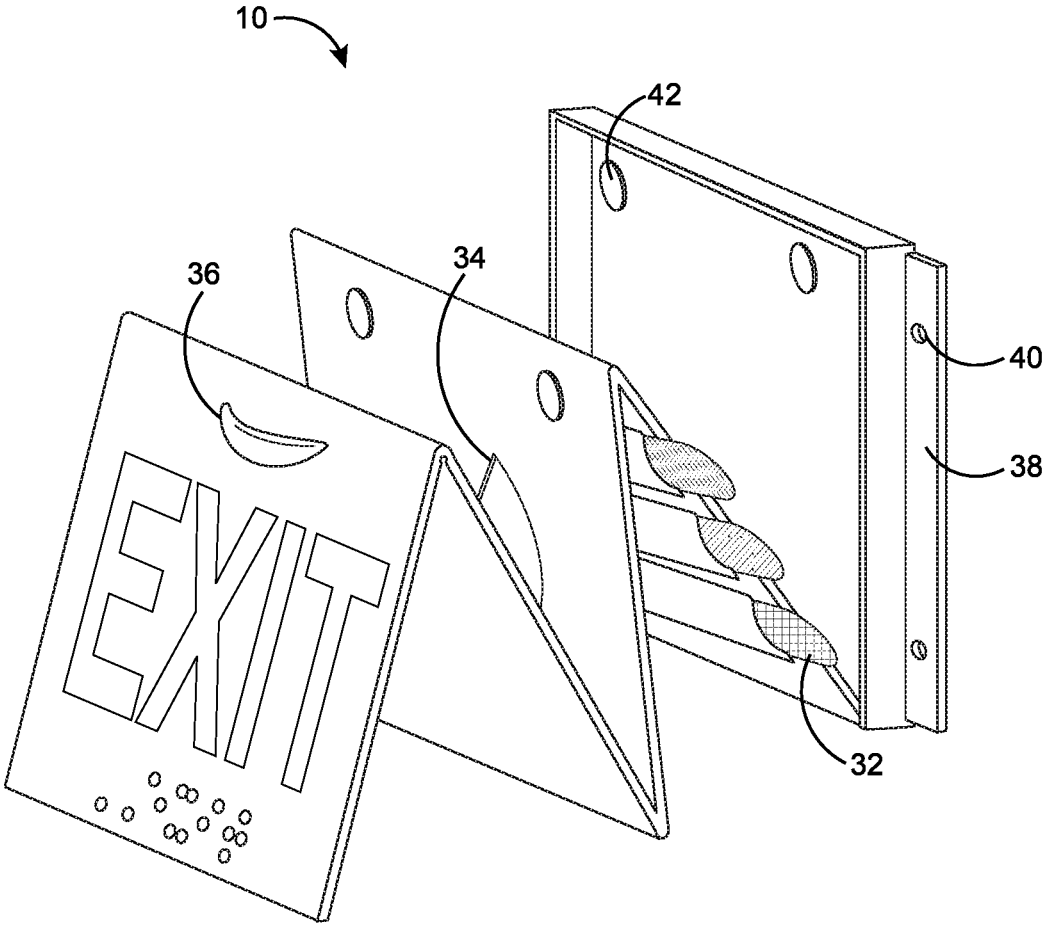
FIG. 2A illustrates a front view of the folded secure exit sign shade in accordance with the preferred embodiment of the present invention.
Figure 2B:
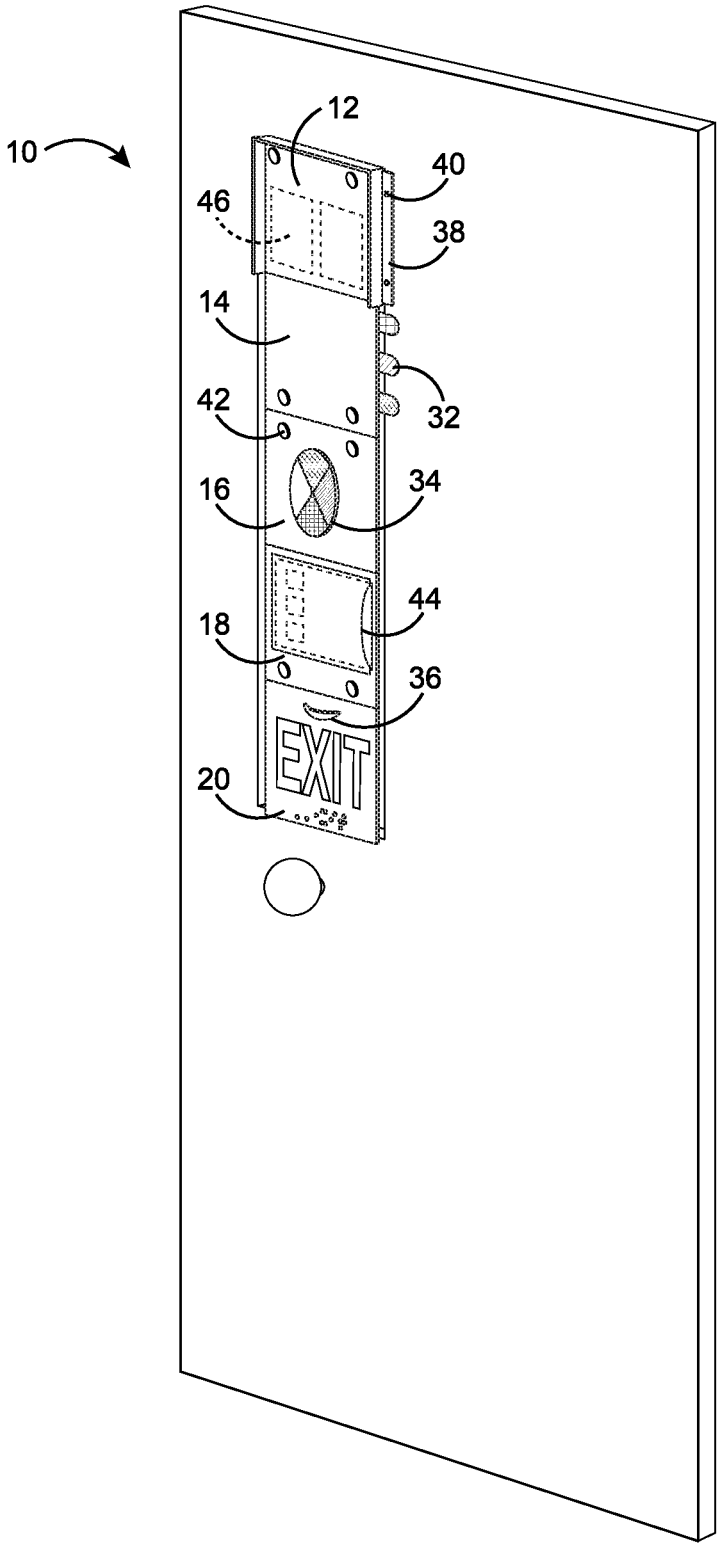
FIG. 2B illustrates a front view of the secure exit sign shade fixed and deployed on the classroom door in accordance with the preferred embodiment of the present invention.

FIGS. 2A and 2B illustrate a front view of the folded secure exit sign shade and a front view of the secure exit sign shade 10 fixed and deployed on the classroom door 28. The FIG. 2A is a folded secure exit shade having five folded sections that is held together using heavy duty magnets 42. The FIG. 2B shows the secure exit sign shade 10 in use when deployed on the class room door window 26. Each section individually displays instructions with different color codes 46 and name list. This helps the teachers to stay in control using the color wheel 34 that indicates the status of the classroom. During a lockdown situation this secure exit shade can solve several problems for teachers in school. In lockdown situation the teachers or other personnel immediately checks the classroom door 28 and look in the hallways to bring in any students who might be outside. Typically, they lock the door 28, cover the viewing window 26, take roll, email designated personnel, and place any color coded cards 46 under the door 28 to indicate the status of the room. The secure exit sign shade 10 serves as an exit sign, and provides a quick reference for the teachers and allows teachers to stay in control using the color wheel 34 to indicate the status of the room, it standardizes the emergency procedures in all schools, it fits seamlessly in the classroom and teachers and personnel can respond faster with the quick references associated to the secure exit shade. The status of the room can be indicated by the form of a wheel, slot, cards, pocket 30 as generally indicated herein, or other means. In one aspect of the preferred embodiment, the secure exit sign shade 10 may or may not be embodied with the pockets 30. Similarly, the secure exit sign shade 10 may or may not include the word 'Exit'. Each section of the fold is attached with a plurality of small hinges 24 that allows the shades to be folded up or down. A cut out tube shaped handle 36 is kept for pulling down the secure exit sign shade 10 that totally covers the window 26 of the classroom door 28 and prevents the visual access of the classroom door window 26 and gives emergency instructions to the teachers. The secure exit sign 10 shade may include bulletproof material to make it more substantial. The secure exit sign shade 10 may also be used in public or private offices and hospitals.

Figure 3A:
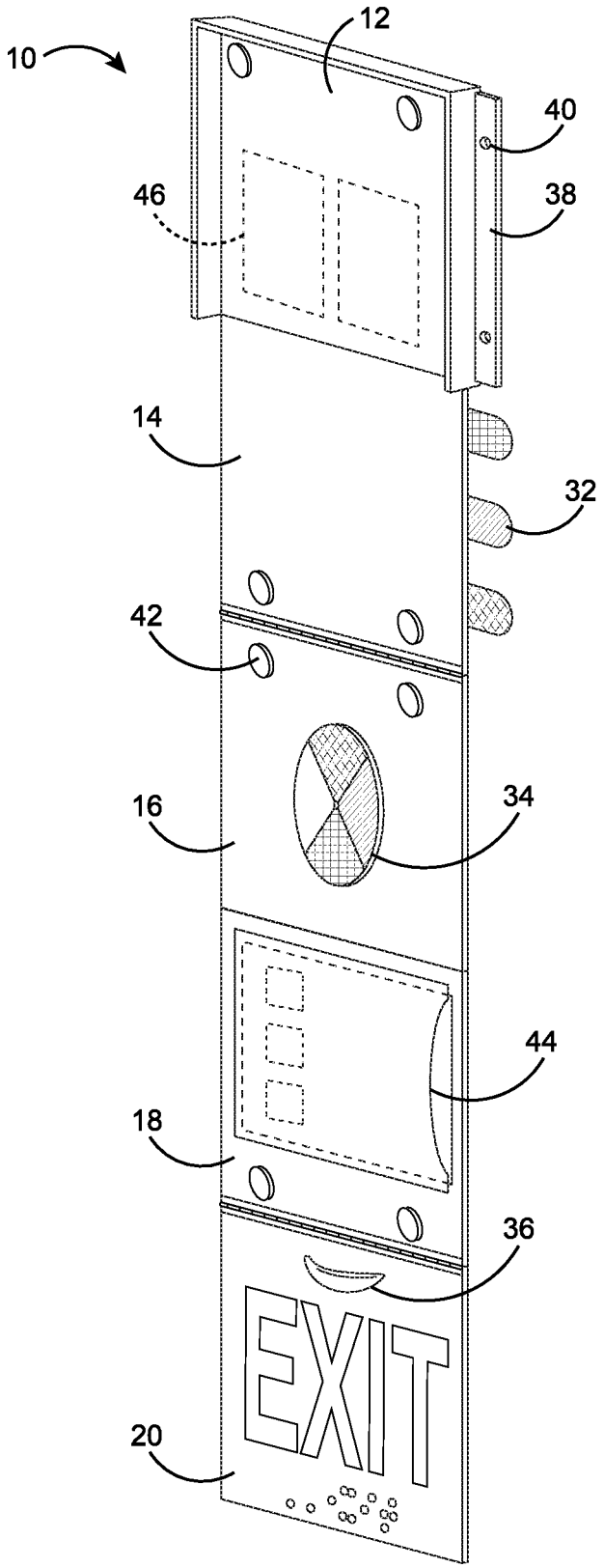
FIG. 3A illustrates a front view of a secure exit sign shade in accordance with the preferred embodiment of the present invention.

FIG. 3A illustrates a front view of a secure exit sign shade 10 wherein the secure exit shade 10 is deployed. This is made of powder coated metal that is folded into five sections and is held together using heavy duty magnets 42. Each section is attached to the other using a small hinge 24 that allows the shade to be folded up or down. The sides of the shade act as feet 38 which are bolted to the inside of classroom doors 28 using four bolts 40. It straddles the window 26 which allows the shade to be moved up or down over the window frame 26 to assure a proper fit. There is a cut out tube shaped handle 36 for pulling down the secure exit shade. When the secure exit sign shade 10 is not deployed or pulled down, it remains folded up at the top of the window 26 displaying the 'Exit' section of the fold.

Each fold section represents different instructions, the first fold section 12 displays with yellow and red color code 46, for instance. The second fold section 14 has a plastic pocket 30, wherein specific instructions for the classroom and/or the class roster 32 can be displayed for convenience. The third fold section 16 has a color wheel 34 that shows the status of the classroom by turning the color wheel 34 and displaying a certain color. The fourth fold section 18 describes what each of the colors means 44 on the status or color wheel 34. For example, red color indicates that there are wounded people inside the classroom, green color indicates all students are accounted for, yellow color indicates that there are missing students or additional students are in the classroom and the white color denies perpetrators knowledge of occupancy in the room. The fifth fold section 20 displays the word 'EXIT'. Plurality of bolts 40 is used for fixing the secure exit sign shade 10 on the classroom door 28. The secure exit sign shade 10 that covers the window 26 of the classroom door 28 and prevents the visual access of the classroom door window 26 and gives emergency instructions to teachers.

Figure 3B:
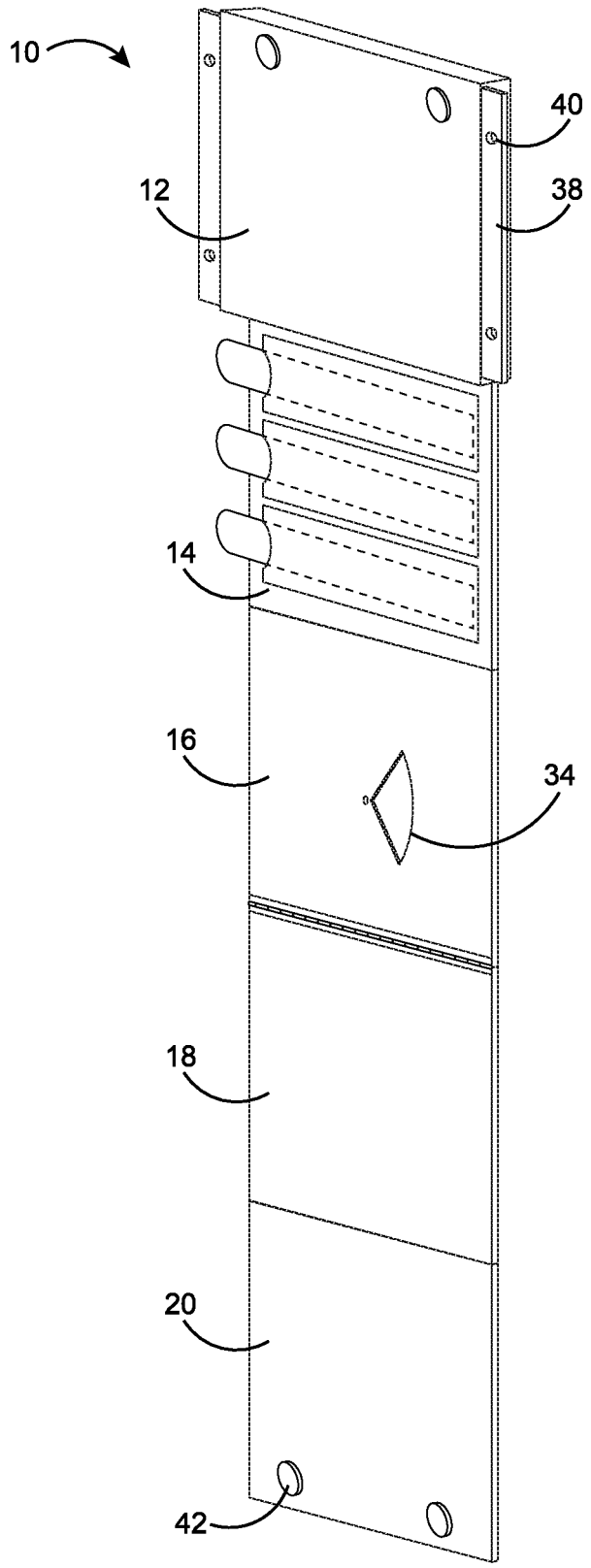
FIG. 3B illustrates a rear view of a secure exit sign shade in accordance with the preferred embodiment of the present invention.

FIG. 3B illustrates a rear view of a secure exit sign shade 10 wherein the secure exit shade is in use when deployed on the classroom door 28. Including the five sections the third fold section displays the color wheel 34. The color wheel 34 is a portion which indicates the status of the room by turning the color wheel 34 and displaying a certain color. On the back of the secure exit sign shade 10 there is a cut out of a triangle which allows the color to be seen by emergency rescue teams or police. Indication on the color wheel 34 creates a major importance for helping rescue team or police.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A shade covering a classroom viewing window and assisting with compliance with emergency protocol during an emergency school lockdown, comprising:

a. the shade comprises a plurality of folds connected to each other by a plurality of hinges;

b. the shade is affixed to a classroom door above said classroom viewing window in a closed and folded position;

c. the shade straddles the classroom viewing window enabling the shade to be moved up and down over a window frame of the classroom door to ensure a proper fit;

d. wherein the shade is configured to cover the classroom viewing window when the shade is unfolded;

e. a set of emergency related information is revealed upon the unfolding of the shade.

2. The shade of claim 1, further comprising a status indicator configured to be visible through the classroom viewing window when the shade is unfolded.

3. The shade of claim 2, wherein the status indicator comprises a wheel with multiple colors, with a different color being viewable through the classroom viewing window depending on the orientation of the wheel.

4. The shade of claim 1, wherein when the shade configured to display an "EXIT" sign when the shade is in a folded position.

5. The shade of claim 1, further comprising a pocket element holding a class roster and emergency instructions.

6. The shade of claim 1, further comprising a cut out tube-shaped handle configured to allow the shade to be unfolded.

7. The shade of claim 1, wherein the shade is made of powder coated metal.

8. The shade of claim 1, wherein the shade is held together using one or more magnets.

9. The shade of claim 1, wherein the shade includes a plurality of bolt holes located on each side of the shade, thereby allowing the shade to be bolted to the classroom door.

10. The shade of claim 1, wherein the shade comprises 5 folds as follows:

a. a first fold displaying code yellow and code red instructions;

b. a second fold including a pocket, the pocket containing a class roster and a set of emergency instructions;

c. a third fold including a color wheel coupled to a cut-out, thereby allowing a status of the classroom to be indicated by turning the color wheel to display a color corresponding to the status;

d. a fourth fold containing information on what each color of the color wheel of the third fold means;

e. a fifth fold displaying the word "EXIT," thereby allowing the shade to function as an exit sign when folded.

11. The shade of claim 10, wherein the information of what each color of the color wheel of the third fold means is as follows:

a. red indicates that there are wounded people inside;

b. green indicates that all students are accounted for;

c. yellow indicates that there are missing students or that there are additional students in the classroom;

d. white indicates no information, thereby denying a perpetrator knowledge of an occupancy of the classroom.

* * * * *